United States Patent [19]

Dilly

[11] Patent Number: 4,490,625

[45] Date of Patent: Dec. 25, 1984

[54] DIMMER CONTROL SWITCH ASSEMBLY FOR LAMPS AND THE LIKE

[76] Inventor: David A. Dilly, 812 East Main St., #1, Lexington, Ky. 40502

[21] Appl. No.: 526,342

[22] Filed: Aug. 24, 1983

[51] Int. Cl.[3] ..... H01H 35/00

[52] U.S. Cl. ..... 307/116; 200/61.52; 315/362

[58] Field of Search ..... 307/112, 116; 335/205, 335/206, 207; 200/61.52; 315/362

[56] References Cited

U.S. PATENT DOCUMENTS 3,161,737 12/1964 Hall ..... 200/61.52

3,161,738 12/1964 Hall ..... 200/61.52

*Primary Examiner*—J. R. Scott

*Attorney, Agent, or Firm*—Mason, Fenwick & Lawrence

[57] ABSTRACT

A dimmer control switch assembly for activating an incandescent lamp bulb or similar controlled appliance or device to assume any of three different illumination intensity states and an OFF state, wherein a Rubik's cube modified to include two magnets forms the activator member. The cube activator member, for example having twenty-seven square cubic elements, has a control face providing four corner cubic elements, the adjoining pair of cubic elements adjacent one of the corner cubic elements each having a button magnet inwardly adjacent their lower faces. A base unit in the shape of a tray member has an upwardly opening square well to receive the control face and adjacent bottom portions of the Rubik's cube activator member nested therein and includes electronic circuitry and magnetically responsive reed switches to be closed in different combinations for four different dispositions of the activator member to activate the lamp at the different states.

12 Claims, 9 Drawing Figures

DIMMER CONTROL SWITCH ASSEMBLY FOR LAMPS AND THE LIKE

BACKGROUND AND OBJECTS OF THE INVENTION

The present invention relates in general to multi-level incandescent lamp illumination control switch devices having a switch activator of a unique toy-type construction, and more particularly to a three-level luminescent lamp control switch structure and Rubik's cube type spatial logical toy activator setting the lamp to different intensities levels or off condition magnetically responsive to positioning of the Rubik's cube activator.

Spatial logical toys of the Rubik's cube type are well known, having achieved significant commercial acceptance in the marketplace and being disclosed in Hungarian Pat. No. 170,062, which describes and illustrates the particular form of the spatial logical toy made up of twenty-seven three dimensional small cubic elements assembled to form a three dimensional solid "large cube" in the assembled state. In this particular form disclosed in the Hungarian patent and as predominantly marketed, the small cubic elements may be turned along the spatial axes of the cube by means of connecting elements arranged in the geometric center of the large cube, and in practice the surfaces of the small cubic elements forming each face of the large cube are colored or carry numbers, figures or other symbols which can be assembled into the predetermined logical order or sequence by simultaneously rotating any of the nine cubic elements forming one of the faces of the large cube.

Variations of the basic twenty-seven element Rubik's cube are disclosed in U.S. Pat. Nos. 4,378,116 showing an eighteen cube element assembly, and 4,378,117 showing and describing an eight cube element assembly.

The present invention involves the concept of incorporating magnets at selected small cubic elements of a conventional Rubik's cube or similar spatial logical toy of three dimensional cube form or solid rectangular form, coactive with a switch assembly base structure in which the Rubik's cube can be removably placed to magnetically activate switches, such as reed switches, in a circuit arrangement adapted to activate an incandescent lamp at any of three intensity levels or place the lamp supply circuit in an off condition depending on the position of the Rubik's cube activator on the base. More specifically, a conventional Rubik's cube in accordance with the present invention is to be provided with two concealed button magnets of small size, incorporated as by retrofitting them in two of the small cubic elements of the Rubik's cube at predetermined positions, together with provision of a base structure having a printed circuit board and magnetic reed switches and electronic components incorporated thereon, adapted to be interposed by an intercepting or "piggy-back" type plug/-socket connector interposed in the supply line for an incandescent lamp. For example, the interceptor plug/-socket is plugged into the supply outlet in the building wall from which the lamp is to be electrically supplied, with the lamp supply cord plug coupled into the intercept plug/socket, whereby the magnets when positioned in a specific order act as a key or control code to allow the switch control circuit in the base portion to energize the lamp to three different intensity levels by rotating the Rubik's cube activator to three different positions spaced at 90° intervals from each other and to place the lamp in "off" condition when rotated to a fourth position.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
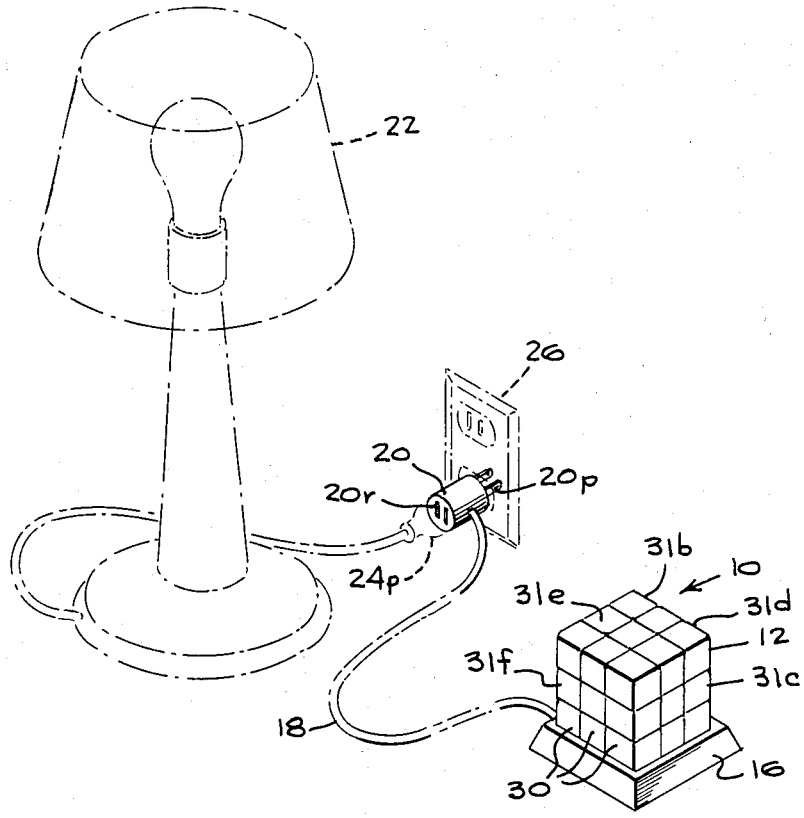
FIG. 1 is a perspective view of the Rubik's cube activator and associated control switch base structure of the present invention interconnected in an electrical supply circuit system for an incandescent lamp, with the lamp and its supply cord and the building wall electrical convenience outlet indicated in broken lines.
Figure 2:
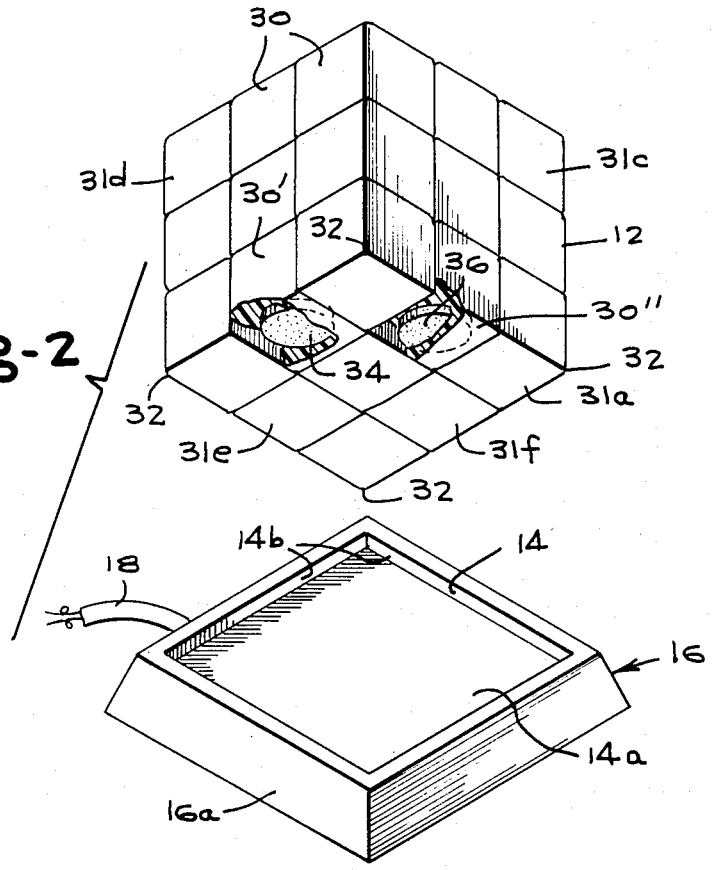
FIG. 2 is an exploded perspective view of the Rubik's cube type activator and control switch base unit, with the bottom surface of the Rubik's cube activator turned upwardly to visible position and parts of the two small cubic elements having button magnets therein broken away to reveal the buttom magnets.

Referring to the drawings, wherein like reference characters designate corresponding parts throughout the several figures, the Rubik's cube and control switching base assembly lamp illumination control unit of the present invention is indicated generally by the reference character 10, and comprises, in the preferred embodiment, a twenty-seven cubic element Rubik's cube, indicated generally by the reference character 12, forming the "large cube" actuator component of the present invention, adapted to be removably mounted in the upwardly opening shallow square well 14 of the control switching base unit 16. The base unit 16 has an electrical supply cord 18 extending therefrom and a combined male-female interpose plug 20 forming both a two-prong receptacle portion and a two-prong plug portion **20*r* and 20*p* adapted to be interposed in the power supply system to an electrically energized convenience device, such as, in the preferred embodiment, a luminescent lamp, but which may be an audible signalling device, a radio or sound source, a display source or the like. The ensuing description will proceed with the assumption that the device 22 is a luminescent lamp of conventional construction to be regulated by the control unit to assume an off condition, or any of three different dimmed conditions representing a lower intensity, a medium intensity and a high intensity level of illumination. The lamp 22 in the illustrated embodiment has a conventional two wire supply cord 24 extending from the lamp to a conventional male plug 24***p*, for example of the two prong type, adapted to be inserted into the prong sockets of a conventional convenience supply outlet, as indicated phantom lines at 26.

The Rubik's cube 12, which forms the novel multiple intensity level and on/off control activator for the lamp control system, indicated generally by the reference character 12, as disclosed in the Hungarian Pat. No. 170,062 comprises a plurality, in this case twenty-seven, identical three dimensional cubic elements 30 assembled together with interconnecting structure as disclosed in the Hungarian or U.S. patents for manipulation in accordance with the teachings of those patents and the commercial devices supplied thereunder, defining six outer cube faces 31*a*–31*f* bounded by eight corners indicated generally by the reference character 32. In accordance with the construction of the commercially marketed twenty-seven element Rubik's cube toy or the construction shown in the above identified Hungarian patent, any nine of the cubic elements 30 forming one of the surfaces or outer cube faces 31*a*–31*f* may be rotated in a known manner to displace the cubic elements 30 relative to each other in various color patterns or numeral patterns or indicia patterns. To adapt a conventional commercially available Rubik's cube 12 to use as the control switching activator for the present invention, a conventional commercial Rubik's cube is retrofitted to provide two button magnets, indicated by the reference characters 34 and 36, in two of the next-to-corner cubic elements 30' and 30'' immediately adjacent one face 31*a* of the activator cube 12. The button magnets 34 and 36 may be incorporated in the next-to-corner cubic elements 30', 30'', for example by prying out a center edge of the associated cubic element for the face 31*a*, or otherwise penetrating the plastic material forming the face portion of the plastic cubic element 30' or 30'', installing the button magnet 34 or 36 therein, for example a ½" button magnet of thin configuration, and if desired stuffing some sort of flexible polyfoam or similar filling material therein to avoid rattling, and reclosing the plastic face of the penetrated cubic element 30' or 30''. The two button magnets 34, 36 are arranged in substantially the same plane parallel to the plane of the face 31*a* and lying immediately inwardly of that face abutting the interior surface of the plastic material forming the face 31*a*.

In use, the face 31*a* of the Rubik's cube activator member 12 is intended to be disposed face down against the upwardly facing bottom or base surface 14*a* and interfit within the shallow rectangular well close to but slightly larger than the horizontal dimensions of the Rubik's cube activator unit as defined by the side walls 14*b* of the well 14 so that the lower or bottom portion of the Rubik's cube activator member 12 easily removably interfits it to and may be withdrawn from the well 14. In the illustrated example, the exterior walls of the base unit 16 are in the form of outwardly inclined beveled surfaces 16*a* or whatever artistic appearance is desired for the exterior surfacing of the base unit 16.

Figure 4:
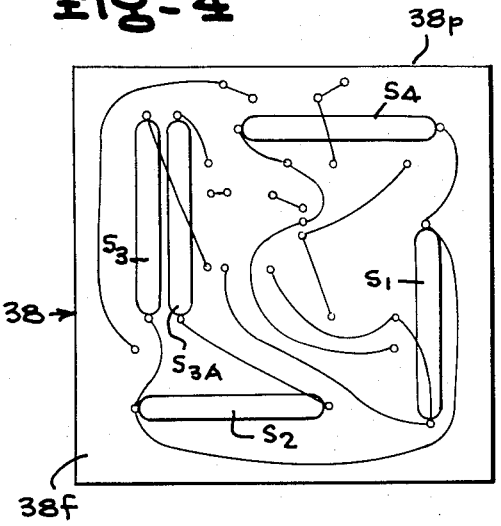
FIG. 4 is a diagram of a printed circuit board (PCB) assembly which may be used to provide the circuit of FIG. 3, viewed from the foil side showing the reed switches mounted thereon.
Figure 5:
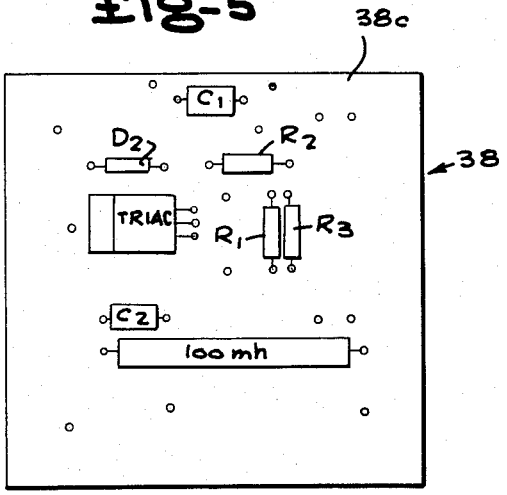
FIG. 5 is a view of the circuit board of FIG. 4, viewed from the parts side opposite the side seen in FIG. 4.

The base unit 16 forms a housing for the electronic control switching circuitry to control the illumination levels and the on/off condition of the lamp 22, and, in the preferred embodiment, is in the form of a printed circuit board (PCB) circuit structure, indicated generally by the reference character 38, connected to the base unit supply cord 18 and interposed plug 20 previously identified. The printed circuit board 38 is of conventional mechanical construction providing a main PCB panel member 38*p* having a foil side 38*f* shown in FIG. 4 and a component side 38*c* shown in FIG. 5. On the foil side 38*f* of the PCB panel member 38*p*, a combination of five magnetic reed switches indicated by reference characters S1, S2, S3, S3A and S4 are provided, interconnected in an electrical circuit arrangement as shown in FIG. 3, while the remaining electrical components identified in FIG. 3 are mounted on the component side 38*c* of the printed circuit board as illustrated in FIG. 5.

Figure 3:
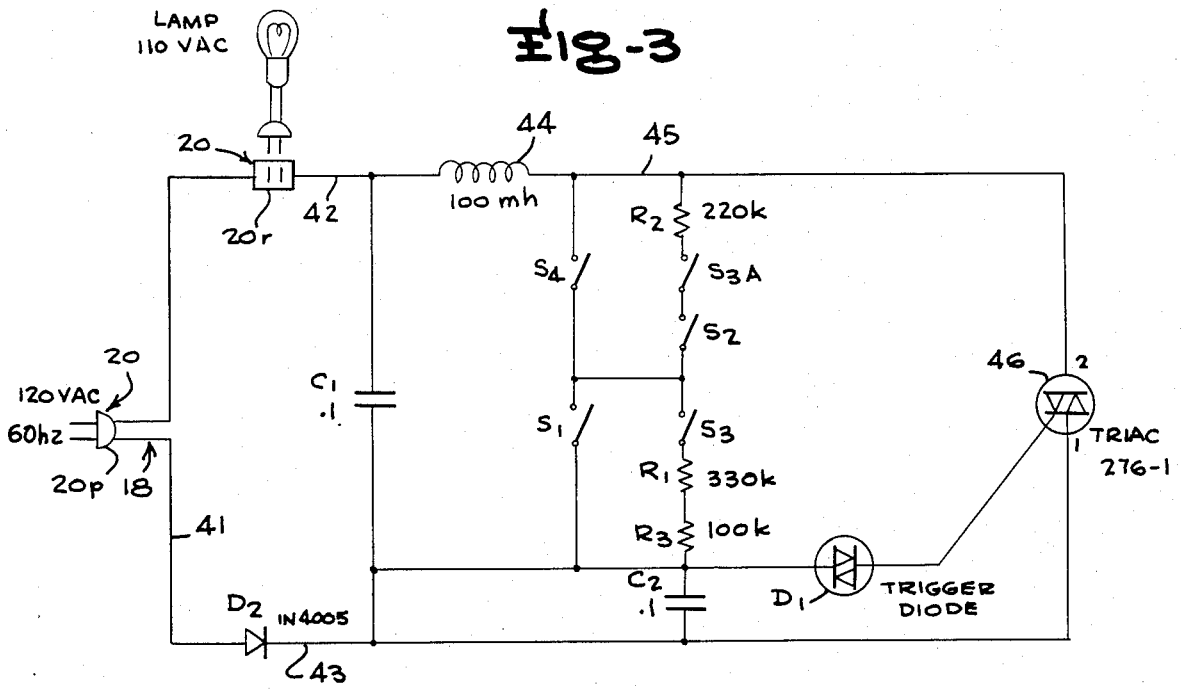
FIG. 3 is a schematic diagram of an electrical control switch circuit which may be provided in the control switch base unit in accordance with the present invention.

Referring to the schematic circuit of FIG. 3, the circuitry which may be employed in the base unit 16 may be as illustrated wherein the pair of leads 40, 41 extend from the male plug 20*p*, the lead 40 connecting to the female plug portion 20*r* and the lead 41 connecting to a diode D2, which may be a 1N4005 diode to provide half wave rectification of the ac supply current and produce half wave dc current for reducing lamp power consumption and increasing lamp life. A capacitor C1 is connected across the leads 42, 43 as shown, and the lead 42 connects to an inductance coil 44, for example a 100 mh coil. Connected across the lead 45 extending from the coil 44 and the continuation of the lead 43 is a triac 46 controlled by a trigger diode D1 connected to the lower end of an array of gate resistances R1, R2 and R3 and associated switches S1, S2, S3, S3A, and S4 as shown. The capacitor C2 is also connected from the lower end of the array of gate resistors to the lower lead 43.

Figure 6A:
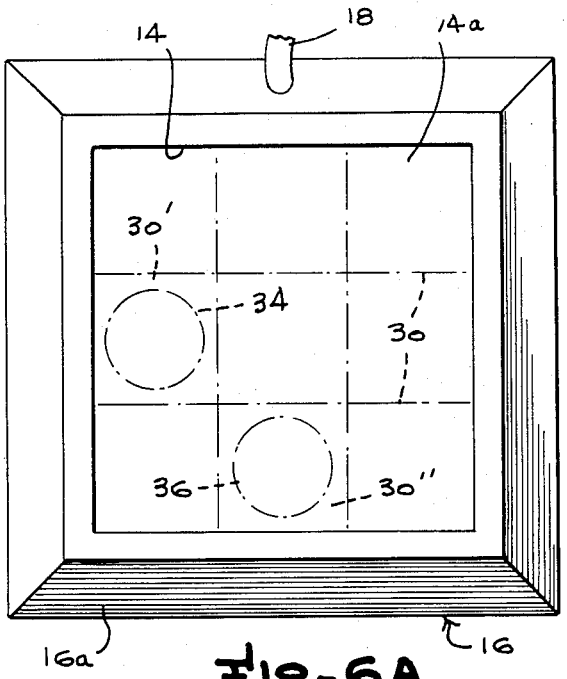
FIGS. 6A, 6B, 6C, and 6D are somewhat diagrammatic top plan views of the control switch base unit with the Rubik's cube activator and its button magnets shown thereon in broken lines at proper positions of the Rubik's cube for low intensity, medium intensity, high intensity, and off conditions of the lamp controlled thereby.
Figure 6B:
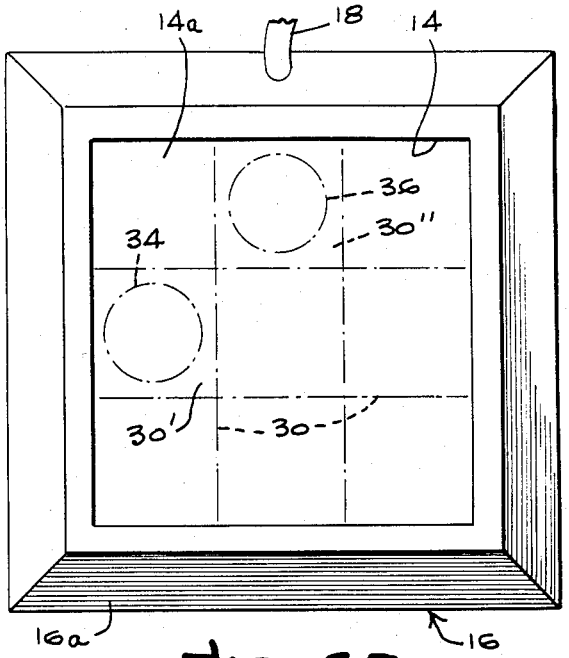
Figure 6C:
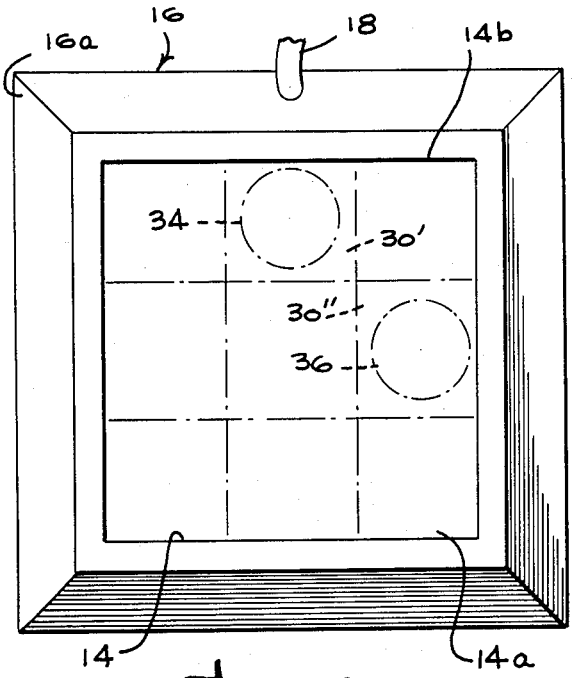
Figure 6D:
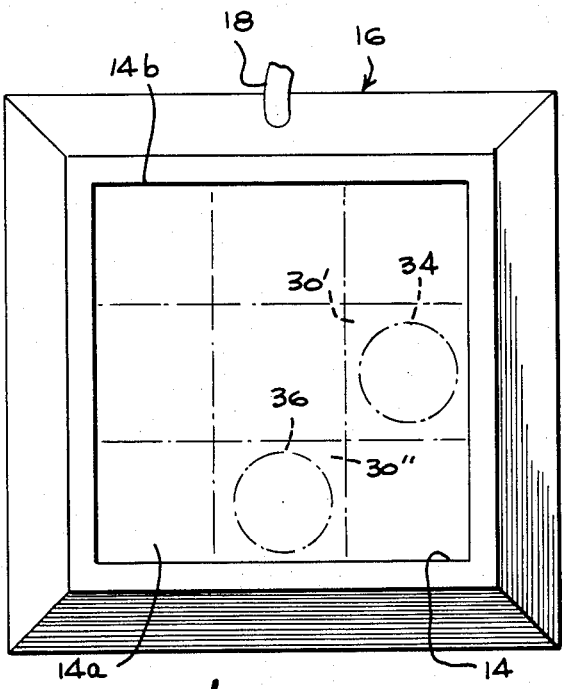

With this circuit arrangement, placing of the Rubik's cube activator member 12 in the well of the base unit 16 in the position shown in FIG. 6A positions the magnets 34 and 36 to close the magnetic reed switches S2, S3 and S3A, thus directing the current path through all three resistors R1, R2 and R3 and providing lowest intensity current to the lamp placing it in the lowest of the three illumination intensity levels. Positioning of the Rubik's cube activator 12 in the well of the base unit 16 in the position of FIG. 6B positions the magnets 34 and 36 to close the switches S3, S3A and S4, placing only the resistors R1 and R3 in the current path and providing the medium illumination intensity level. Positioning the Rubik's cube activator member 12 in the FIG. 6C position closes the switches S4 and S1, thus taking all of the resistors R1, R2 and R3 out of the current path and providing the maximum intensity or high intensity illumination level. When the Rubik's cube activator is placed in the FIG. 6D position in the base unit 16, only switches S1 and S2 are closed, and since switches S3, S3A and S4 are in open position, there is no circuit path through the array of gate resistances and switches and therefore the supply to the lamp is placed in the off condition.

I claim:

1. A dimmer control switch assembly for activating an incandescent lamp bulb to assume any of three different ON states at three illumination intensity levels and an OFF state, comprising a Rubik's cube-type spatial toy activator member in the form of a six-faced geometric solid having a plurality of substantially square flat faces including a control face adapted to be disposed in downwardly facing relation and subdivided into plural square face elements arranged to provide four corner face elements and first and second next-to-corner face elements adjacent one of said corner face elements and displaced toward such corner from the center of said control face, a base unit in the shape of a tray member adapted to rest on a horizontal support surface and having an upwardly opening four corner well bounded by a horizontal base surface and shallow side wall portions to receive the control face and adjacent bottom portions of the Rubik's cube activator member nested therein, said activator member including a pair of magnets incoporated in the first and second face element portions of the activator member, the tray member including electronic circuit means comprising a plurality of magnetically responsive reed switches located immediately below said horizontal base surface in predetermined positions adjacent corners of the well to be closed in selected different combinations correlated to the locations of said magnets for four different dispositions of the Rubik's cube activator member control surface in the well, the electronic circuit means including resistor means and circuitry interconnected with said switches to produce electrical current levels for energizing the lamp at any of said three different intensity levels and at the fourth OFF state correlated to the positions of said Rubik's cube activator member, and a supply cord and adaptor plug member having both electrical plug and socket formations thereon to be interconnected with a supply cord plug for the lamp and an electrical supply outlet for controlling the lamp.

2. A dimmer control switch as defined in claim 1, wherein said control face of said activator member is in the configuration of a square having an outer diagonal axis extending through the center and two opposite corners thereof and said magnets being located immediately above and within the bounds of said first and second face elements with the latter positioned between face elements at said two opposite corners and said one of said corner face elements.

3. A dimmer control switch as defined in claim 1, wherein said control face of said activator member is in the configuration of a square having an outer diagonal axis extending through the center and two opposite corners thereof and said magnets being located immediately above and within the bounds of said first and second face elements with the latter positioned between face elements at said two opposite corners and said one of said corner face elements, the magnets being thin magnets having their centers disposed along an axis paralleling said center diagonal axis.

4. A dimmer control switch as defined in claim 1, wherein said control face of said activator member is in the configuration of a square having an outer diagonal axis extending through the center and two opposite corners thereof and said magnets being located immediately above and within the bounds of said first and second face elements with the latter positioned between face elements at said two opposite corners and said one of said corner face elements, the magnets being thin circular button-shaped magnets having their centers disposed along an axis paralleling said center diagonal axis.

5. A dimmer control switch assembly for activating a controlled electrical appliance to assume any of three ON states at three different intensity levels and an OFF condition, comprising a Rubik's cube-type spatial toy activator member in the form of a six-faced geometric solid having a plurality of substantially square flat faces including a control face adapted to be disposed in downwardly facing relation and subdivided into plural square face elements arranged to provide four corner face elements and first and second next-to-corner face elements adjacent one of said corner face elements and displaced toward such corner from the center of said control face, a base unit in the shape of a tray member adapted to rest on a horizontal support surface and having an upwardly opening four corner well bounded by a horizontal base surface and shallow side wall portions to receive the control face and adjacent bottom portions of the Rubik's cube activator member nested therein, said activator member including a pair of magnets incorporated in the first and second face element portions of the activator member, the tray member including electronic circuit means comprising a plurality of magnetically responsive reed switches located immediately below said horizontal base surface in predetermined positions adjacent corners of the well to be closed in selected different combinations correlated to the locations of said magnets for four different dispositions of the Rubik's cube activator member control surface in the well, the electronic circuit means including resistor means and circuitry interconnected with said switches to produce electrical current levels for energizing the lamp at any of said three different intensity levels and at the fourth OFF state correlated to the positions of said Rubik's cube activator member, and a supply cord and adaptor plug member having both electrical plug and socket formations thereon to be interconnected with a supply cord plug for the lamp and an electrical supply outlet for controlling the lamp.

6. A dimmer control switch as defined in claim 5, wherein said control face of said activator member is in the configuration of a square having an outer diagonal axis extending through the center and two opposite corners thereof and said magnets being located immediately above and within the bounds of said first and second face elements with the latter positioned between face elements at said two opposite corners and said one of said corner face elements.

7. A dimmer control switch as defined in claim 5, wherein said control face of said activator member is in the configuration of a square having an outer diagonal axis extending through the center and two opposite corners thereof and said magnets being located immediately above and within the bounds of said first and second face elements with the latter positioned between face elements at said two opposite corners and said one of said corner face elements, the magnets being thin magnets having their centers disposed along an axis paralleling said center diagonal axis.

8. A dimmer control switch as defined in claim 5, wherein said control face of said activator member is in the configuration of a square having an outer diagonal axis extending through the center and two opposite corners thereof and said magnets being located immediately above and within the bounds of said first and second face elements with the latter positioned between face elements at said two opposite corners and said one of said corner face elements, the magnets being thin circular button-shaped magnets having their centers disposed along an axis paralleling said center diagonal axis.

9. A dimmer control switch assembly for activating an incandescent lamp bulb to assume any of three different ON states at three illumination intensity levels and an OFF state, comprising a Rubik's cube spatial toy activator member in the form of a geometric solid having six square outer bounding faces including a control face adapted to be disposed in downwardly facing relation, the cube activator member being subdivided into at least twenty-seven square cubic elements having element faces forming said control face providing four corner cubic elements and first and second immediately adjoining cubic elements adjacent one of said corner cubic elements and displaced toward such corner from the center of said control face, a base unit in the shape of a tray member adapted to rest on a horizontal support surface and having an upwardly opening square well having four corners bounded by a horizontal base surface and shallow side wall portions to receive the control face and adjacent bottom portions of the Rubik's cube activator member nested therein, said activator member including a pair of magnets incorporated in bottom portions of said first and second cubic elements, the tray member including electronic circuit means comprising a plurality of magnetically responsive reed switches located immediately below said horizontal base surface in predetermined positions adjacent corners of the well to be closed in selected different combinations correlated to the locations of said magnets for four different dispositions of the activator member control surface in the well of said tray member, the electronic circuit means including resistor means and circuitry interconnected with said switches to produce electrical current levels for energizing the lamp at any of said three different intensity levels and interrupt electrical supply to the lamp at the fourth OFF position correlated to the positions of said Rubik's cube activator member, and a supply cord and adaptor plug member having both electrical plug and socket formations thereon to be interconnected with a supply cord plug for the lamp and an electrical supply outlet for controlling the lamp of said Rubik's cube activator member, and a supply cord and adaptor plug member having both electrical plug and socket formations thereon to be interconnected with a supply cord plug for the lamp and an electrical supply outlet for controlling the lamp.

10. A dimmer control switch as defined in claim 9, wherein said control face of said activator member is in the configuration of a square having an outer diagonal axis extending through the center and two opposite corners thereof and said magnets being located immediately above said element faces thereof within the bounds of said first and second cubic elements with the latter positioned between face elements at said two opposite corners and said one of said corner face elements.

11. A dimmer control switch as defined in claim 9, wherein said control face of said activator member is in the configuration of a square having an outer diagonal axis extending through the center and two opposite corners thereof and said magnets being located immediately above said element faces thereof within the bounds of said first and second cubic elements with the latter positioned between face elements at said two opposite corners and said one of said corner face elements, the magnets being thin magnets having their centers disposed along an axis paralleling said center diagonal axis.

12. A dimmer control switch as defined in claim 9, wherein said control face of said activator member is in the configuration of a square having an outer diagonal axis extending through the center and two opposite corners thereof and said magnets being located immediately above said element faces thereof within the bounds of said first and second cubic elements with the latter positioned between face elements at said two opposite corners and said one of said corner face elements, the magnets being thin circular button-shaped magnets having their centers disposed along an axis paralleling said center diagonal axis.

* * * * *